US009847590B2

(12) United States Patent
Kim et al.

(10) Patent No.: US 9,847,590 B2
(45) Date of Patent: Dec. 19, 2017

(54) REINFORCED SHIELD TYPE CONNECTOR

(71) Applicant: MOLEX INCORPORATED

(72) Inventors: Kwang Sik Kim, Ansan (KR); Suk Min Kim, Ansan (KR)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/110,777

(22) PCT Filed: Jan. 23, 2015

(86) PCT No.: PCT/KR2015/000717
§ 371 (c)(1),
(2) Date: Jul. 11, 2016

(87) PCT Pub. No.: WO2015/111951
PCT Pub. Date: Jul. 30, 2015

(65) Prior Publication Data

US 2016/0336668 A1 Nov. 17, 2016

(30) Foreign Application Priority Data

Jan. 23, 2014 (KR) ..... 10-2014-0008511

(51) Int. Cl.

| | |
|---|---|
| ***H01R 13/15*** | (2006.01) |
| ***H01R 13/62*** | (2006.01) |
| ***H01R 12/79*** | (2011.01) |
| ***H01R 12/88*** | (2011.01) |
| ***H01R 13/6594*** | (2011.01) |
| ***H01R 13/6599*** | (2011.01) |

(52) U.S. Cl.
CPC ..... *H01R 12/79* (2013.01); *H01R 12/88* (2013.01); *H01R 13/6594* (2013.01); *H01R 13/6599* (2013.01)

(58) Field of Classification Search
CPC ..... H01R 12/79; H01R 12/87; H01R 12/88
USPC ..... 439/260, 495
See application file for complete search history.

(56) References Cited

U.S. PATENT DOCUMENTS

| | | | | |
|---|---|---|---|---|
| 6,224,418 | B1 * | 5/2001 | Miura | H01R 12/79 439/260 |
| 6,517,367 | B2 * | 2/2003 | Yamane | H01R 12/88 439/260 |
| 6,524,124 | B2 * | 2/2003 | Yamane | H01R 12/88 439/260 |
| 6,902,425 | B2 * | 6/2005 | Huang | H01R 13/502 439/495 |
| 6,949,316 | B2 * | 9/2005 | Aoki | H01R 12/88 439/260 |

(Continued)

FOREIGN PATENT DOCUMENTS

| | | |
|---|---|---|
| JP | 2000-106237 A | 4/2000 |
| JP | 2010-114046 A | 5/2010 |

(Continued)

*Primary Examiner* — Hae Moon Hyeon
(74) *Attorney, Agent, or Firm* — James A. O'Malley

(57) ABSTRACT

This invention relates to a connector, and more specifically, to a shield type connector which reinforces the strength of a housing and an actuator. The shield type connector of this invention includes a housing metal shell made of a metallic material, furnished in the housing in order to reinforce the strength of the housing, and an actuator metal shell made of a metallic material, furnished in the actuator in order to reinforce the strength of the actuator.

16 Claims, 5 Drawing Sheets

(56) References Cited

U.S. PATENT DOCUMENTS

| | | | | |
|---|---|---|---|---|
| 6,994,591 | B2 * | 2/2006 | Huang | H01R 23/662 439/495 |
| 7,001,208 | B2 * | 2/2006 | Huang | H01R 12/88 439/260 |
| 7,762,826 | B2 * | 7/2010 | Hemmi | H01R 13/193 439/260 |
| 7,789,688 | B2 * | 9/2010 | Hemmi | H01R 12/771 439/260 |
| 8,083,542 | B2 | 12/2011 | Kodaira | |
| 2009/0298315 | A1 * | 12/2009 | Iida | H01R 12/79 439/259 |

FOREIGN PATENT DOCUMENTS

| | | | |
|---|---|---|---|
| JP | 4964013 | A2 | 6/2012 |
| JP | 2013-145659 | A | 7/2013 |
| KR | 2010-0109427 | A | 10/2010 |
| KR | 2010-0109482 | A | 10/2010 |
| KR | 10-2010-0119412 | A | 10/2011 |
| KR | 2011-0132821 | A | 12/2011 |
| KR | 10-2012-0056911 | A | 6/2012 |
| KR | 10-1124847 | B1 | 6/2012 |

* cited by examiner

[Fig. 1]
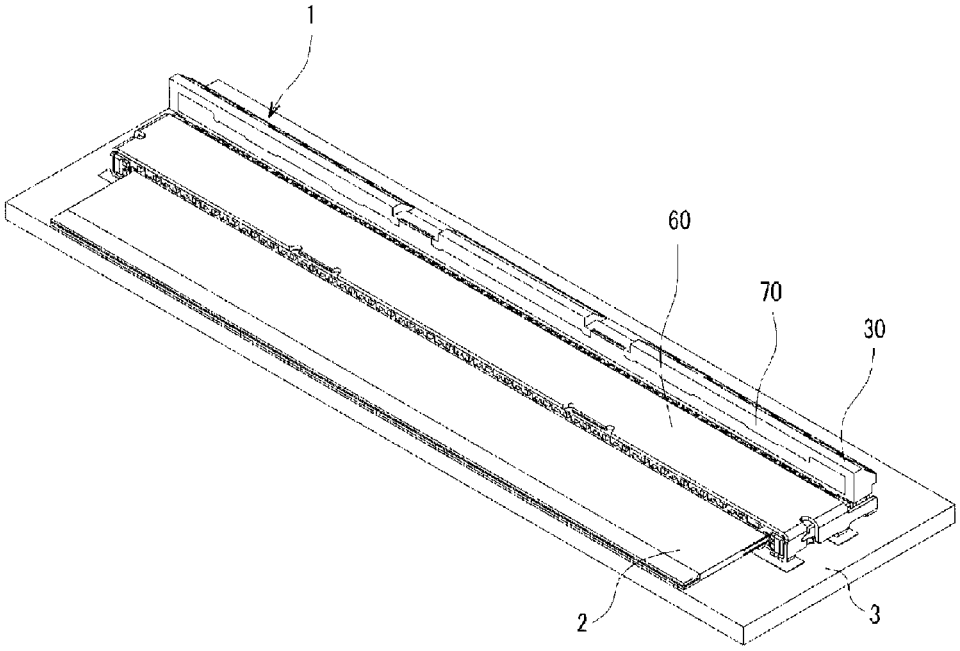
[Fig. 2]
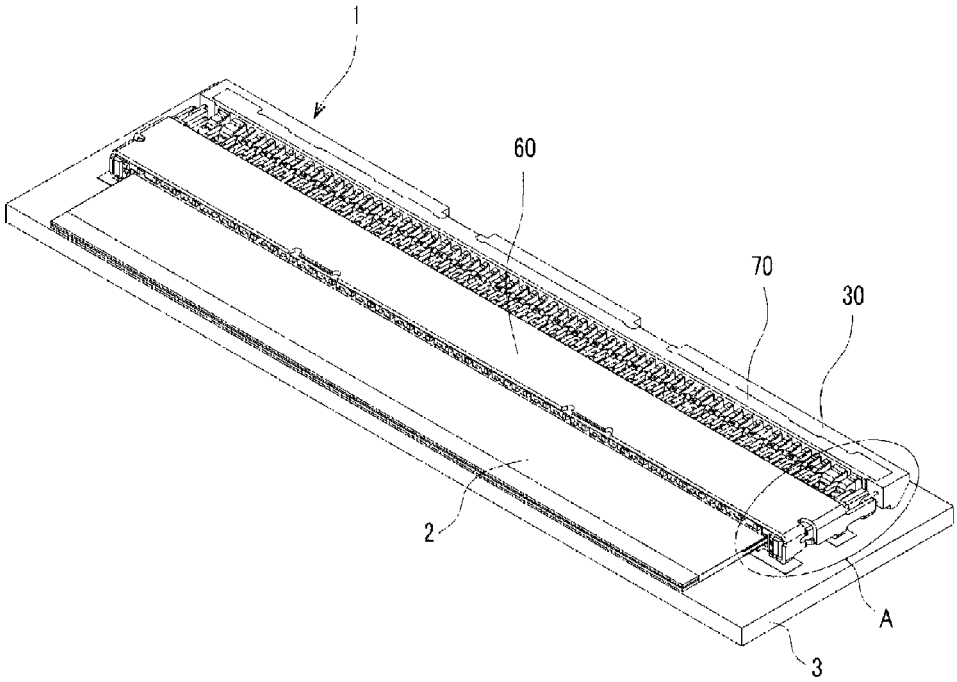

[Fig. 3]
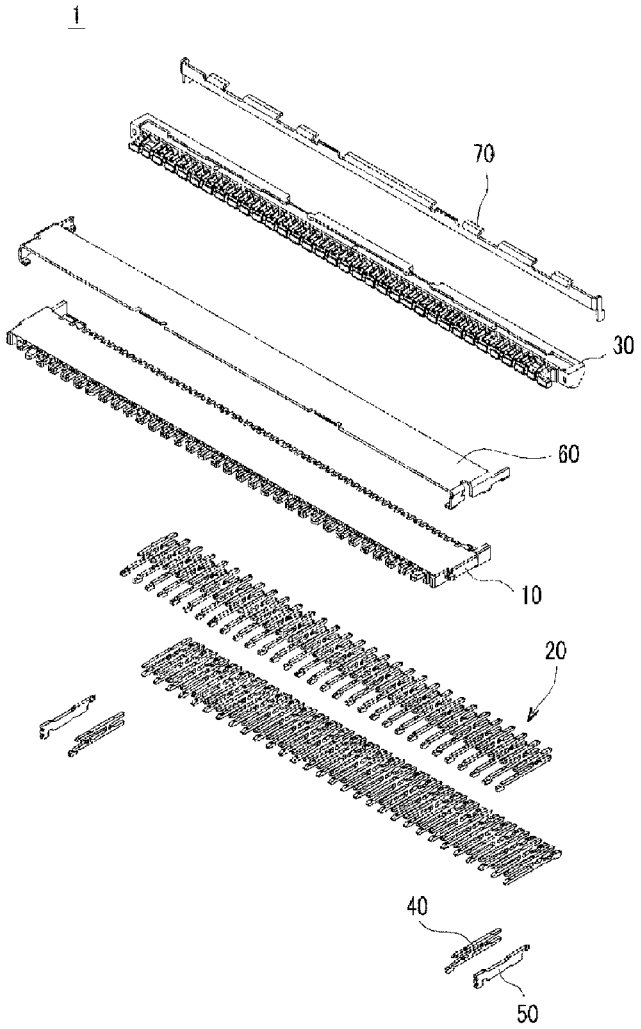
[Fig. 4]
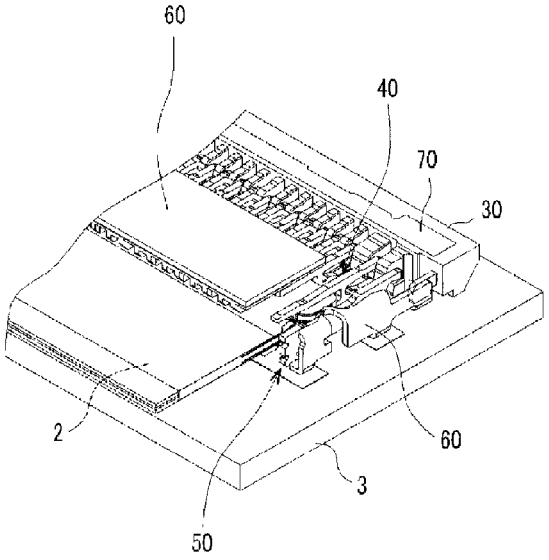

[Fig. 5]
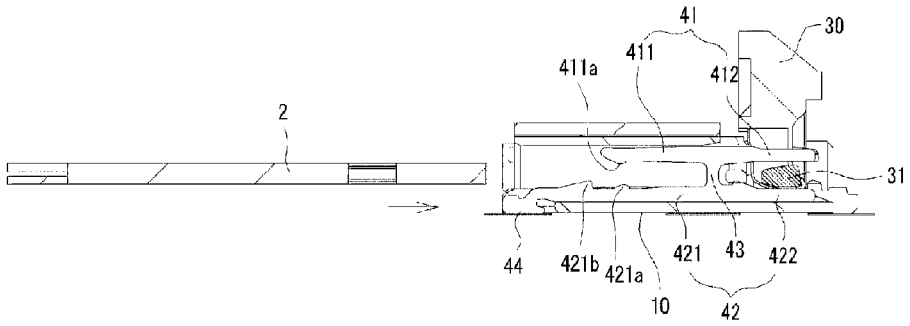
[Fig. 6]
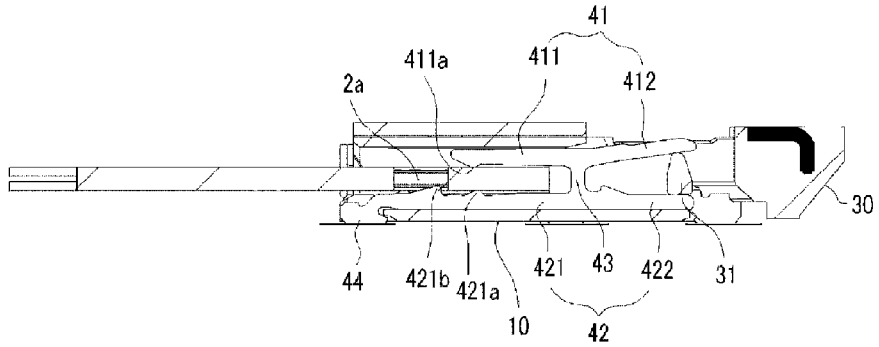
[Fig. 7]
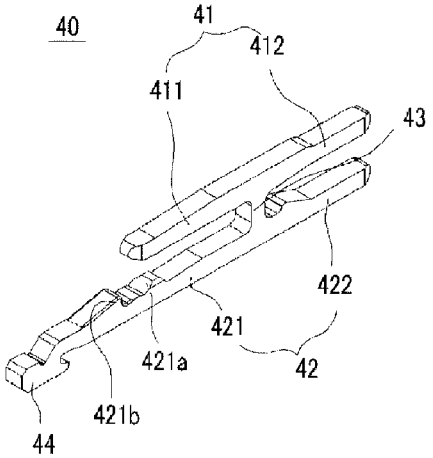
[Fig. 8]
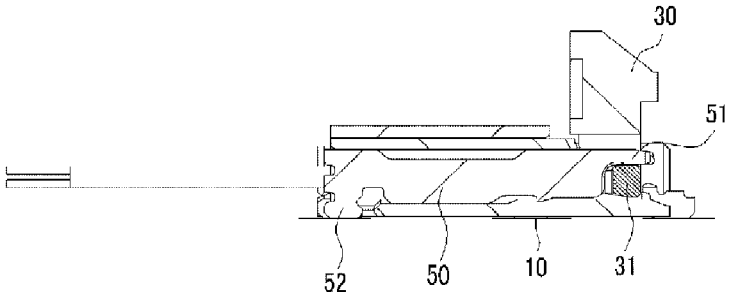

[Fig. 9]
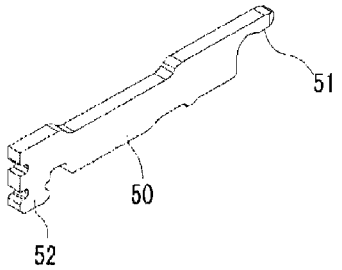
[Fig. 10]
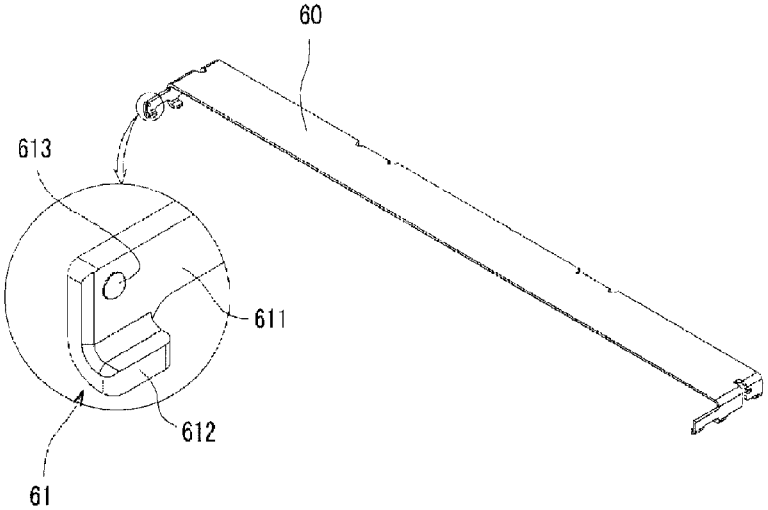
[Fig. 11]
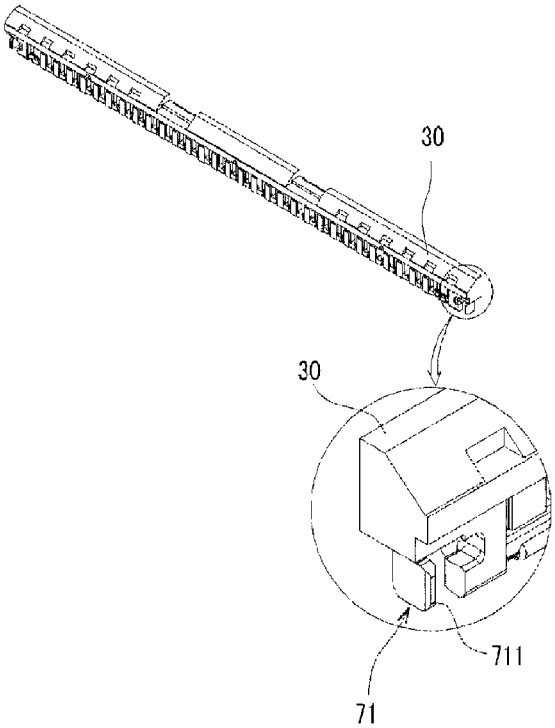

[Fig. 12]
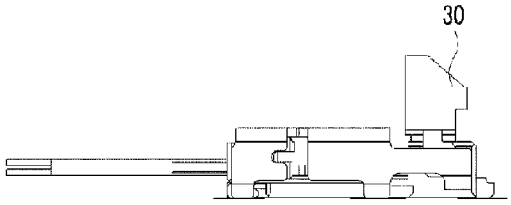
[Fig. 13]
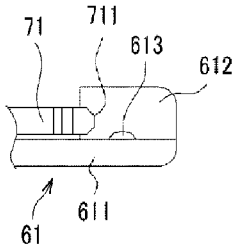
[Fig. 14]
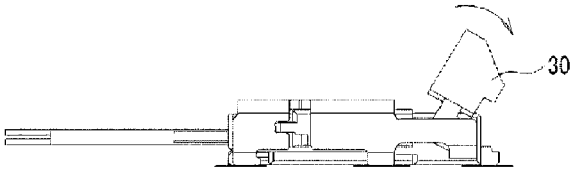
[Fig. 15]
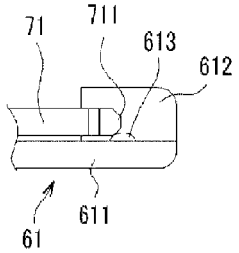
[Fig. 16]
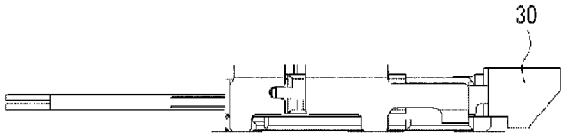
[Fig. 17]
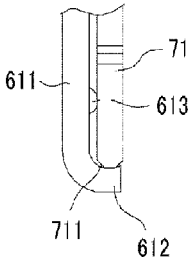

REINFORCED SHIELD TYPE CONNECTOR

RELATED APPLICATIONS

This application claims priority to PCT Application No. PCT/KR2015/000717, filed Jan. 23, 2015, which claims priority to Korean Patent Application No. 10-2014-0008511, filed Jan. 23, 2014, both of which are incorporated herein by reference in their entirety.

TECHNICAL FIELD

This invention relates to a flexible circuit board connector, and more specifically to a shield-type connector that reinforces the strength of the housing and actuator and also, by means of a grounded electrical current-carrying structure, establishes a protective film to prevent electromagnetic interference.

BACKGROUND ART

Electronic devices such as smartphones or notebook computers, etc., are gradually becoming slimmer, and consequently the various parts assembled therewithin are also becoming smaller. In particular, connectors that connect parts and printed circuit boards (PCBs) are also becoming smaller and slimmer.

Connectors include flexible printed circuit (FPC) connectors that connect a FPC board and PCB. Typically, a FPC connector consists of a housing into which the FPC is inserted, and an actuator that locks/unlocks the FPC to/from the housing.

In an FPC connector of the prior art having such a configuration, in particular in the case of a low-profile connector, the upper surface of the housing which was fabricated from plastic would often be damaged when the FPC was inserted into the housing so as to press the actuator.

To address this problem, connectors reinforced by mounting a housing metal shell in the housing have been developed, and such a connector is disclosed in Republic of Korea Unexamined Patent Publication No. 2010-0109482 (hereinafter "Reference 1") under the name of an "electrical connector for use in a circuit board."

Accordingly, because the FPC connectors of the prior art were grounded only to the PCB and not to the FPC, the problem arose that electromagnetic interference (EMI, NOISE) made high-speed signal transmission impossible.

To solve this problem, in Korean Unexamined Patent Publication No. 2011-0132821 (hereinafter "Reference 2"), a connector having both a plurality of surface mount technology (SMT) ground terminals grounded to the PCB and a plurality of ground terminals grounded to the FPC is disclosed, under the name of a "flexible connector for high-speed signal transmission."

Although said References 1 and 2 advantageously reinforce connector strength and block electromagnetic interference, neither is able to effectively block external physical shocks and electromagnetic interference.

Specifically, the References have the problem that although they reinforce the strength of the housing by furnishing a housing metal shell, they leave the problem completely unaddressed of the strength of the actuator that opens/closes to lock/unlock.

In addition, it must be borne in mind that there is no ability to block electromagnetic interference in Reference 1; and in Reference 2, although there is the capacity partially to block electromagnetic interference due to the conductive structure connecting the FPC, shell, and PCB, it is not possible to form a protective film that blocks electromagnetic interference across the entire connector.

PRIOR ART REFERENCES

Republic of Korea Unexamined Patent Publication 2010-0109482 (2010.10.08.)

Republic of Korea Unexamined Patent Publication 2011-0132821 (2011.12.09.)

Republic of Korea Unexamined Patent Publication 2010-0109427 (2010.10.08.)

SUMMARY

The purpose of this invention, which has been devised in order to address the above-described problems of the prior art, is to provide a shield-type connector that can improve physical strength throughout.

Another objective of this invention is to provide a shield type connector that can form a protective film to prevent electromagnetic interference throughout.

The shield type connector of this invention comprises: a housing metal shell made of a metallic material and furnished on a housing in order to reinforce the strength of the housing; and an actuator metal shell made of a metallic material and furnished on an actuator in order to reinforce the strength of the actuator.

An electrical connection is made among: a 1st fitting nail that is mounted on the housing so as to lock/unlock the FPC and is in physical contact with the FPC; an FPC inserted into the housing; the housing metal shell; and the actuator metal shell; so as to establish a ground path.

The 1st fitting nail is physically contacted to the FPC so as to make an electrical connection, and the 1st fitting nail is electrically connected to the housing metal shell via a PCB; the housing metal shell and actuator metal shell are electrically connected by physical contact.

The actuator metal shell is in physical contact with the housing metal shell when in the closed state; they are separated when in the open state.

The actuator metal shell is formed as a single unit on the actuator, by overmolding.

The actuator metal shell and housing metal shell are in electrical contact with one another via a dual-contact structure having 2 contact points.

The 1st shell contact part within said housing metal shell that physically contacts the actuator metal shell comprises: a side part extending backward from the side part of the housing metal shell; a surface contact part in the form of a surface that extends inward from the back end of the side part and physically contacts the actuator metal shell; and a point contact part in the form of a bump that protrudes inward from the side of the side part and physically contacts the actuator metal shell.

The rotation axle of the actuator metal shell has a cross section in the shape of a cam; the 2nd shell contact part of the actuator metal shell, which is in physical contact with the housing metal shell, is in physical contact with the 1st shell contact part only when the actuator is closed.

The 2nd shell contact part is formed in a plate shape, and on the end that points backward when the actuator is open, a sloped surface is formed that slopes from either side toward the center, so that when the actuator is being closed, the point contact part contacts the side of said 2nd shell contact part after sliding along the sloped surface, and when the closure of the actuator is complete, the sloped surface is in physical contact with the surface contact part of the housing metal shell.

The 1st fitting nail has a pair of FPC contact parts spaced vertically, and each FPC contact part has a contact bump respectively formed that contacts the FPC.

When the actuator is open, the contact between the FPC contact part and the FPC is loosened, so that the FPC can be inserted and removed; and when the actuator is closed, the two FPC contact parts are pulled together by the rotation axle of the actuator as the FPC is locked into place.

The shield type connector of this invention further comprises a 2nd fitting nail that is formed separately from the 1st fitting nail and is mounted on the housing so as to prevent the detachment of the actuator.

An uplift prevention lip is formed on the 2nd fitting nail so as to prevent the actuator from lifting up and keep the actuator in the open state unless external force is applied.

Effects of the Invention

The shield type connector of this invention has the following effects.

First, the housing is covered with a metal shell, and the strength of the connector is reinforced by furnishing a metal shell on the actuator, so that the lifespan of the connector can be increased.

Second, by means of a total ground path consisting of the FPC, 1st fitting nail, housing metal shell and actuator metal shell, a protective film (electric field) is formed across the entire connector to prevent electromagnetic interference, so that the signal transmission capability can be greatly improved.

Third, because of the dual-contact structure having 2 contact points between the housing metal shell and actuator metal shell, electrical connectivity is smoothly established between the housing metal shell and actuator metal shell, and the electrical connection can be maintained well even when vibrations are transmitted from the exterior.

Fourth, by forming the 1st fitting nail and 2nd fitting nail separately, plating can be done efficiently when applying different coatings to the 1st fitting nail and 2nd fitting nail.

Fifth, because of the actuator closure prevention structure that can keep the actuator in its open state, the actuator can be packaged and supplied, and SMT processes can be carried out, with the actuator in its open state.

BRIEF DESCRIPTION OF THE DRAWINGS

FIG. 1 is an oblique view of the actuator of the connector according to a preferred embodiment of this invention, in its opened state.

FIG. 2 is an oblique view of the actuator of the connector according to a preferred embodiment of this invention, in its closed state.

FIG. 3 is an exploded oblique view of the connector according to a preferred embodiment of this invention.

FIG. 4 is an enlarged partially-dissected oblique view of the housing and housing metal shell shown in part A of FIG. 2.

FIGS. 5 and 6 are cross-sections showing the relationships between the 1st fitting nail, FPC, and actuator.

FIG. 7 is a diagram of the 1st fitting nail.

FIG. 8 is a cross-section showing the relationship between the 2nd fitting nail and actuator.

FIG. 9 is an oblique view of the 2nd fitting nail.

FIG. 10 is an oblique view of the edge of either side of the housing metal shell.

FIG. 11 is an oblique view of the either-end part of the actuator.

FIG. 12 is a side view of the actuator in an opened state.

FIG. 13 is a top view showing the relationship between the housing metal shell and the actuator metal shell when the actuator is open.

FIG. 14 is a side view of the process of closing the actuator.

FIG. 15 is a top view showing the relationship between the housing metal shell and the actuator metal shell when the actuator is being closed.

FIG. 16 is a side view of the actuator in closed state.

FIG. 17 is a bottom view showing the relationship between the housing metal shell and the actuator metal shell when the actuator is closed.

DETAILED DESCRIPTION OF THE PREFERRED EMBODIMENTS

Hereinbelow, a preferred embodiment of the shield type connector of this invention will be described in detail with reference to the attached drawings.

FIG. 1 is an oblique view of an actuator 30 of a connector 1 according to a preferred embodiment of this invention, in its opened state; FIG. 2 is an oblique view of the actuator 30 of the connector 1 according to a preferred embodiment of this invention, in its closed state; FIG. 3 is an exploded oblique view of the connector 1 according to a preferred embodiment of this invention.

The connector 1 according to a preferred embodiment of this invention includes a housing 10, a plurality of terminals 20, the actuator 30, fitting nails 40, 50 and a housing metal shell 60.

The housing 10 is furnished with an insertion part opened to the front so that a FPC 2 can be removably inserted; terminal recesses are formed spaced apart to left and right, so that a plurality of terminals 20 can be disposed spaced apart. The housing 10 is fabricated from a plastic material.

The terminals 20 are disposed at intervals on the housing 10 and soldered to a PCB 3. The terminals 20 contact the FPC 2 that is inserted into the housing 10 so that the terminals 20 electrically connect, and serves as a route for transmitting signals between, the FPC 2 and the PCB 3.

The actuator 30 is connected rotatably to a rear part of the housing 10 so as to lock/unlock the FPC 2 in the housing 10. As shown in FIG. 1, when the actuator 30 is in an open state in which it has been turned perpendicularly, the FPC 2 can be inserted into the housing 10 or separated from the housing 10. As shown in FIG. 2, when the actuator 30 is in a closed state in which it has been turned backward, the inserted FPC 2 is firmly locked into the housing 10 and contact is established between the FPC 2 and the terminals 20.

The 1st fitting nail 40 is mounted to either side of the housing 10 to lock/unlock the FPC 2; when the actuator 30 is closed, a conductive path is formed to enable electrical contact between the FPC 2 and the PCB 3.

The 2nd fitting nail 50 is mounted on either side of the housing 10 so as to prevent detachment of the actuator 30 installed rotatably on the housing 10, and enables smooth rotation of the actuator 30.

The housing metal shell 60 surrounds the top surface of the housing 10 and either end is soldered to the PCB 3, thereby extending the lifespan of the housing 10 by reinforcing the strength of the housing 10.

An actuator metal shell 70 for reinforcing strength is formed as a single unit on the actuator 30 by overmolding. The actuator metal shell 70 extends the lifespan of the actuator 30 by reinforcing the strength of the actuator 30, just as the housing metal shell 60 reinforces the strength of the housing 10.

FIG. 4 is an enlarged partially-dissected oblique view of the housing 10 and the housing metal shell 60 shown in part A of FIG. 2.

The 1st and 2nd fitting nails 40, 50 are respectively furnished on either end of the housing 10 and the bottom parts thereof are soldered to the PCB 3. When the actuator 30 is closed, the 1st fitting nail 40 locks the FPC 2 into place while also electrically connecting to the FPC 2. The 2nd fitting nail 50 provides support to enable the actuator 30 to remain in an open or closed state.

Either end part of the housing metal shell 60 is soldered to the PCB 3, and a rear end of either end part is optionally in physical contact with the actuator metal shell 70. In other words, the housing metal shell 60 and actuator metal shell 70 are spaced apart when the actuator 30 is open, and are not electrically connected; but when the actuator 30 is closed, they come into physical and electrical contact.

When the actuator 30 is in a closed state, the FPC 2 and the 1st fitting nail 40 are mutually electrically contacted by physical contact, and the 1st fitting nail 40 and the housing metal shell 60 are in mutual electrical contact via the PCB 3; the housing metal shell 60 and the actuator metal shell 70 are in mutual electrical contact due to physical contact.

By means of this total ground path, full shield structure is established that forms a protective film (electric field) across the entire connector 1 to block electromagnetic interference, so that the signal transmission capability can be greatly improved, and as a result, a great improvement in signal transmission capability can be effectuated.

FIGS. 5 and 6 are cross-sections showing the relationships between the 1st fitting nail 40, the FPC 2, and the actuator 30; FIG. 7 is a diagram of the 1st fitting nail 40.

The 1st fitting nail 40 is formed in an H shape and is installed to the front and back of the edge part of the housing 10. An upper nail part 41 and a lower nail part 42, positioned in line with one another, are connected by means of a connecting part 43. With respect to the connecting part 43, toward the front, an FPC insertion space is formed whereinto the FPC 2 is inserted; the FPC insertion space is surrounded by a pair of FPC contact parts 411, 421, with FPC contact part 411 being an upper FPC contact part and FPC contact part 421 being a lower FPC contact part. With respect to the connecting part 43, toward the back, a rotation axle insertion space is formed whereinto a rotation axle 31 of the actuator 30 is inserted; the rotation axle insertion space is surrounded by a pair of rotation axle insertion parts 412, 422.

On a lower surface of the upper FPC contact part 411, a joining bump 411*a* projects downward that joins and contacts with an upper surface of the FPC 2; on an upper surface of the lower FPC contact part 421, a joining bump 421*a* projects upward that joins and contacts with a lower surface of the FPC 2. The two joining bumps 411*a*, 421*a* are formed in mutually corresponding locations. On the upper surface of the lower FPC contact part 421, in front of the joining bump 421*a*, a locking bump 421*b* projects upward to lock the FPC 2 in place. The locking bump 421*b* is fastened to a locking recess 2*a* formed on either edge of the FPC 2 so as to lock the FPC 2 into place.

In a front part of the lower FPC contact part 421, a soldering part 44 is formed that is soldered to the PCB 3.

An actuator rotation axle 31 in the form of a cam is inserted between the rotation axle insertion parts 412, 422. As shown in FIG. 5, when the actuator 30 is in an open state, a long part of the rotation axle 31 is in a horizontal state, so that the two rotation axle insertion parts 412, 422 are not pressed, and therefore the two rotation axle insertion parts 412, 422 and the two FPC contact parts 411, 421 remain in their original state. Accordingly, the FPC 2 can be inserted between the two FPC contact parts 411, 421, and the FPC 2 can be removed from the two FPC contact parts 411, 421.

As shown in FIG. 6, when the actuator 30 is in a closed state, the long part of the rotation axle 31 is in a perpendicular state, and the two rotation axle insertion parts 412, 422 are pushed apart. When the two rotation axle insertion parts 412, 422 are pushed apart, the two FPC contact parts 411, 421, which extend in line with the two rotation axle insertion parts 412, 422, are pulled together, and firmly join with and lock into place the FPC 2 that has been inserted therebetween. Because joining bumps 411*a*, 421*a* are formed on both of the two FPC contact parts 411, 421, the junction is established without any difficulty even if the FPC 2 is inserted upside-down.

The upper nail part 41 and the lower nail part 42 are formed in a structure wherein they are separated by the connecting part 43, so that because of their own elasticity, when the actuator 30 is rotated from a closed to an open state, they are again restored to their original condition.

FIG. 8 is a cross-section showing the relationship between the 2nd fitting nail 50 and the actuator 30; FIG. 9 is an oblique view of the 2nd fitting nail 50.

The 2nd fitting nail 50 prevents uplift of the actuator 30 so that the actuator 30 cannot be separated from the housing 10. On a rear end of the 2nd fitting nail 50, an uplift prevention lip 51 is formed that prevents uplift by pressing on the rotation axle 31 of the actuator 30. In a front part of the 2nd fitting nail 50, a soldering part 52 is formed that is soldered to the PCB 3.

When the actuator 30 is in its open state as shown in FIG. 8, the actuator 30 is kept in the open state unless the actuator 30 is rotated by external force, due to the surface contact of the rotation axle 31 with the uplift prevention lip 51. Due to this structure, the connector 1 can be packaged and supplied, and SMT processes can be completed, all while the actuator 30 is in an open state.

By forming the 1st and 2nd fitting nails 40, 50 separately, plating is facilitated when applying different platings to the two fitting nails 40, 50. For example, when gold-plating only the contact point of the 1st fitting nail 40, plating is not straightforward due to the 2nd fitting nail 50 if the 1st and 2nd fitting nails 40, 50 are connected; but gold-plating of the 1st fitting nail 40 can be easily performed in this invention because the two fitting nails 40, 50 are separate from one another.

FIG. 10 is an oblique view of an edge of either side of the housing metal shell 60; FIG. 11 is an oblique view of the either-end part of the actuator 30; FIG. 12 is a side view of the actuator 30 in an opened state; FIG. 13 is a top view showing the relationship between the housing metal shell 60 and the actuator metal shell 70 when the actuator 30 is open; FIG. 14 is a side view of the process of closing the actuator 30; FIG. 15 is a top view showing the relationship between the housing metal shell 60 and the actuator metal shell 70 when the actuator 30 is being closed; FIG. 16 is a side view of the actuator 30 in closed state; FIG. 17 is a bottom view showing the relationship between the housing metal shell 60 and the actuator metal shell 70 when the actuator 30 is closed.

On a back of either side part of the housing metal shell 60, a 1st shell contact part 61 is formed that optionally contacts the actuator metal shell 70, and on either side of the actuator metal shell 70, a 2nd contact part 71 is formed that optionally contacts the 1st shell contact part 61 of the housing metal shell 60.

The 1st shell contact part 61 includes a side part 611 extending backward from the side of the housing metal shell 60, a surface contact part 612 in the form of a surface that extends inward from the back end of the side part 611 and physically contacts the 2nd shell contact part 71, and a point contact part 613 in the form of a bump that protrudes inward from the side part 611 and physically contacts the side of the 2nd shell contact part 71.

The 2nd shell contact part 71 is formed in the shape of a plate, and when the actuator 30 is in the open position, a sloped surface 711 is formed on the rear-facing end, tapering toward the center from either side.

Because the rotation axle 31 of the actuator 30 is formed in the shape of a cam, when the actuator 30 is rotated, the 2nd shell contact part 71 does not rotate in place but changes position as it rotates.

Specifically, as shown in FIGS. 12 and 13, when the actuator 30 is in its open state, the 2nd shell contact part 71 is positioned above the surface contact part 612 in a state separated laterally from the side part 611, and is positioned in front of the point contact part 613 so as to be spaced apart from the 1st shell contact part 61.

As shown in FIGS. 14 and 15, in order to close the actuator 30, when rotated, the 2nd shell contact part 71 moves backward as it rotates, and when the actuator 30 is fully closed, as shown in FIG. 17, the 2nd shell contact part 71 additionally moves backward.

As the 2nd shell contact part 71 moves backward while rotating, the sloped surface 711 initially contacts the point contact part 613 of the 1st shell contact part 61. In other words, it has the effect of the bump-shaped point contact part 613 sliding relatively along the sloped surface 711. After the point contact part 613 has slid relatively along the sloped surface 711, when it contacts the side of the 2nd shell contact part 71, the point contact part 613 is firmly contacted to the side of the 2nd shell contact part 71 by the elastic force of the side part 611 of the housing metal shell 60 itself.

As shown in FIGS. 16 and 17, when the actuator 30 is fully closed, the sloped surface 711 of the 2nd shell contact part 71 is firmly contacted to the top surface of the surface contact part 612 of the 1st shell contact part 61. A sloped surface is also formed between the side part 611 and surface contact part 612 of the 1st shell contact part 61, and the sloped surface of the 2nd shell contact part 71 is in surface contact with the surface contact part 612 and the sloped surface of the 1st shell contact part 61.

As above, when the actuator 30 is in its fully closed state, the 1st shell contact part 61 and 2nd shell contact part 71 have a dual-contact structure having two contact points. Accordingly, destabilization of the electrical connection by vibration can be prevented even when vibrations are transmitted to the connector from the outside.

Hereinabove, the shield type connector of this invention has been described based on a preferred embodiment, but this invention is not limited to any specific embodiment, and a person of ordinary skill in the art of the relevant field will be able to make diverse modifications without departing from the claimed scope of this invention.

The invention claimed is:

1. A shield type connector which is configured to connect a printed circuit board (PCB) to a flexible printed circuit (FPC), the shield type connector comprising:

a housing having front and rear portions, the front portion of the housing being configured to receive the FPC therein, the housing being formed of a non-metallic material;

a plurality of terminals housed in the housing, the plurality of terminals configured to be soldered to the PCB;

a housing shell which surrounds at least a portion of the housing, the housing shell being formed of a metallic material, the housing shell being configured to reinforce a strength of the housing, the housing shell being configured to be soldered to the PCB; and an actuator which is connected to the rear portion of the housing, the actuator having a non-metallic portion and a metallic portion, the actuator being formed by overmolding the non-metallic portion to the metallic portion, the metallic portion being an actuator shell which is configured to reinforce a strength of the actuator, the actuator being movable between an open position and a closed position, wherein when the actuator is in the open position, the actuator allows for the FPC to be inserted into, or removed from, the housing, and the actuator shell is physically separated from the housing shell, and wherein when the actuator is in the closed position, the actuator locks the FPC into the housing in a manner whereby electrical contact is established between the FPC and the plurality of terminals, and the actuator shell is in physical contact with the housing shell such that electrical contact is established between the actuator shell and the housing shell.

2. The shield type connector according to claim 1, further comprising at least one fitting nail which is housed in the housing, the at least one fitting nail being configured to be soldered to the PCB, wherein, when the actuator is in the closed position, the at least one fitting nail is configured to lock the FPC into place such that electrical contact is established between the at least one fitting nail and the FPC.

3. The shield type connector according to claim 2, wherein the at least one fitting nail has upper and lower nail parts and a connecting part which connects the upper nail part to the lower part, the at least one fitting nail being formed in an H-shape configuration whereby the connecting part divides the upper nail part into a forward upper nail part and a rearward upper nail part, and whereby the connecting part divides the lower nail part into a forward lower nail part and a rearward lower nail part.

4. The shield type connector according to claim 3, wherein a forward insertion space is formed between the connecting part and the forward upper and lower nail parts, wherein the forward insertion space is configured to receive the FPC therein.

5. The shield type connector according to claim 4, wherein the forward upper nail part has an upper joining bump extending downwardly therefrom into the forward insertion space, wherein the forward lower nail part has a lower joining bump extending upwardly therefrom into the forward insertion space, and wherein, when the actuator is in the closed position, the upper joining bump is configured to contact an upper surface of the FPC and the lower joining bump is configured to contact a lower surface of the FPC.

6. The shield type connector according to claim 5, wherein the forward lower nail part has a locking bump extending upwardly therefrom, the locking bump being provided forward of the lower joining bump, the locking bump is configured to be fastened to a locking recess of the FPC in order to lock the FPC in place.

7. The shield type connector according to claim 6, wherein the forward lower nail part has a soldering part, the soldering part being provided forward of the locking bump, the soldering part is configured to be soldered to the PCB.

8. The shield type connector according to claim 3, wherein the non-metallic portion of the actuator has a rotation axle having a long part, wherein a rearward insertion space is formed between the connecting part and the rearward upper and lower nail parts, wherein the rearward insertion space is configured to receive the rotation axle therein, and wherein, when the actuator is in the open position, the long part of the rotation axle is in a generally horizontal position relative to the rearward upper and lower nail parts whereby the rotation axle does not press against the rearward upper and lower nail parts, and wherein, when the actuator is in the closed position, the long part of the actuator is in a generally perpendicular position relative to the rearward upper and lower nail parts whereby the rotation axle presses against, and pushes apart, the rearward upper and lower nail parts.

9. The shield type connector according to claim 8, wherein the at least one fitting nail is an at least one first fitting nail, and further comprising at least one second fitting nail which is housed in the housing, the at least one second fitting nail being configured to be soldered to the PCB.

10. The shield type connector according to claim 9, wherein the at least one second fitting nail has a lip formed on a rear end thereof, wherein the lip is configured to press on the rotation axle to prevent uplift of the actuator so that the actuator cannot be separated from the housing.

11. The shield type connector according to claim 1, wherein the housing shell has a contact part formed on a back thereof, the contact part configured to contact the actuator shell when the actuator is in the closed position.

12. The shield type connector according to claim 11, wherein the contact part includes a side part, a surface contact part, and a point contact part, the side part extending rearward from a side of the housing shell, the surface contact part extending inward from a back end of the side part, the point contact part protruding inward from the side part.

13. The shield type connector according to claim 12, wherein the actuator shell has a contact part formed on a side thereof, wherein, when the actuator is in the closed position, the side part is configured to contact the contact part of the actuator shell and the point contact part is configured to contact a side of the contact part of the actuator shell.

14. The shield type connector according to claim 13, wherein the contact part of the actuator shell is formed in the shape of a plate, and wherein, when the actuator is in the open position, a rearward-facing end of the contact part of the actuator shell is sloped such that it tapers toward a center from either side.

15. The shield type connector according to claim 13, wherein, when the actuator is in the open position, the contact part of the actuator shell is positioned above the surface contact part in a state separated laterally from the side part, and is positioned in front of the point contact part so as to be spaced apart from the contact part of the housing shell.

16. The shield type connector according to claim 13, wherein, when the actuator is moved between the open and closed positions, the contact part of the actuator shell moves rearward as it rotates.

* * * * *